US005176287A

United States Patent [19]

Suris

[11] Patent Number: 5,176,287

[45] Date of Patent: Jan. 5, 1993

[54] CAN VENDING MACHINE

[75] Inventor: Vladimir Suris, Mayfield Heights, Ohio

[73] Assignee: Dixie-Narco, Inc., Williston, S.C.

[21] Appl. No.: 723,196

[22] Filed: Jun. 28, 1991

[51] Int. Cl.[5] ..... B65H 3/44

[52] U.S. Cl. ..... 221/93; 221/131; 221/265

[58] Field of Search ..... 221/131, 112, 111, 93, 221/94, 133, 124, 252, 222, 265, 277, 191

[56] References Cited

U.S. PATENT DOCUMENTS

| | | | |
|---|---|---|---|
| 2,789,727 | 4/1957 | Singleton | 221/133 |
| 4,340,151 | 7/1982 | Cottrell | 221/93 |
| 4,588,107 | 5/1986 | Brennan | 221/265 |
| 4,667,847 | 5/1987 | Tucom | 221/265 |
| 4,917,264 | 4/1990 | Gasiel et al. | 221/131 |

*Primary Examiner*—Robert P. Olszewski
*Assistant Examiner*—Kenneth Noland
*Attorney, Agent, or Firm*—Renner, Kenner, Greive, Bobak, Taylor & Weber

[57] ABSTRACT

A can vending machine provides a pair of vertical serpentine passages which can be loaded from a single access area. Serpentine passages are defined by cantilever declined shelves which are interleaved from pairs of walls defining the passages and storage areas. Beneath each of the storage areas is a rotating disc maintained upon a stationary disc or plate, the two discs having similar passages therethrough adapted to accommodate a can. A single motor or solenoid is interconnected with each of the rotatable discs to selectively dispense a can from the associated stack. The serpentine passages prevent the full weight of the can stack from being imposed upon the dispensing discs, but rather upon the cantilevered shelves themselves.

13 Claims, 2 Drawing Sheets

CAN VENDING MACHINE

TECHNICAL FIELD

The invention herein resides in the art of dispensing apparatus and, more particularly, to vending machines of the type adapted for vending cans, bottles, and other appropriate containers. Specifically, the invention relates to a can vending machine in which the cans are maintained in serpentine passages, limiting the load incident to the dispensing mechanism.

BACKGROUND ART

It is well known that soft drinks and other beverages are often dispensed through "vending machines" which maintain a supply of cans, bottles, or other containers of the beverages to be dispensed. The invention herein will be described with respect to the dispensing of cans, although it will be appreciated that the concept of both the instant invention and the prior art are equally extendable to the vending of bottles, or other suitable containers.

In the prior art, a vending machine would typically house a plurality of vertical stacks of cans. These stacks would be defined between vertical slats having a dispensing mechanism disposed at the bottom thereof. The stacks have been known to take on various configurations, accommodating either a single array of cans lying on their side and in tangential contact with each other, or a double array of cans in similar arrangement. It has further been known that the slats can be extended in depth to accommodate a similar stack of cans behind the stack just described. The nature of the stack employed is typically a function of the popularity of the drink positioned within the stack.

The dispensing mechanism associated with each of the stacks is, of course, tailored to the stack configuration. Typically, the dispensing mechanism comprises a semi-cylindrical member positioned beneath the stack and adapted to receive a can from the stack and to rotate about an axis orthogonal to the axis of the stack to dispense the can therefrom. The cans are typically dispensed through openings provided in the side slats of the stacks. Of course, the particular configuration of the semicylindrical member and the openings in the slats are dependent upon the specific stack arrangement.

In the previously known prior art, as the semicylindrical member or trough was rotated in the dispensing cycle, the entire load of the stack of cans bore against it. Indeed, in the prior art the rotation of the dispensing mechanism would typically lift the entire stack an amount dependent upon the skewed nature of the cans within the stack to each other. In other words, the spacing of the slats would typically allow the cans to alternate from side to side within the stack, each can resting between a side slat and the can therebeneath. The staggering of the cans, resulting from the fact that the cans are not axially aligned with each other, causes each can as it is dispensed to roll against the can immediately above it, urging the entire stack upwardly. Accordingly, an exceptional amount of load is exerted upon the dispensing mechanism.

For the reasons presented above, the prior art has taught the implementation of heavy duty motors for rotating the semicylindrical dispensing troughs. Additionally, the type of motor employed has been a function of the specific nature of the stack with which it is associated. Obviously, the load imparted by a single stack of cans is substantially less than that imparted by double or quadruple stacks as described above. Cost savings therefore dictate that minimum motor size be employed for each of the associated stacks.

In the prior art described above, there is also an inordinate waste of space resulting from the need for a clearance between the sides of the cans and the stack slats. A drive motor is associated with each stack, such drive motor further adding to the cost of the machine and taking up space in the front section of the vender which could otherwise be employed by cans to be dispensed.

In the prior art, the loading of the stacks was also found to be a difficult proposition, since each can is entered into the stack at the point at which it will be maintained. The operator begins at the bottom of the stack and sequentially loads cans upwardly to the top thereof, making the loading process labor intensive. Additionally, the prior art just described has typically required a locking mechanism with the dispensing apparatus, the same adding to the cost and complexity of the system.

DISCLOSURE OF INVENTION

In light of the foregoing, it is a first aspect of the invention to provide a can vending machine adaptable to wide and narrow columns or stacks, and in which the same dispensing mechanism can be employed irrespective of the nature of the stack.

Yet a further aspect of the invention is the provision of a can vending machine in which the motor size can be considerably reduced over the prior art and in which the dispensing mechanism is not called upon to lift the can stacks or bear the weight thereof during the dispensing process.

Another aspect of the invention is the provision of a can vending machine in which the number of dispensing motors or dispensing mechanisms is greatly reduced over the prior art, and wherein a single dispensing motor or mechanism can be employed to service two stacks or columns.

An additional aspect of the invention is to provide a can dispensing machine in which the dispensing apparatus is self-locking requiring no brake for locking purposes.

An additional aspect of the invention is the provision of a can dispensing machine which achieves better utilization of space within the machine, allowing for improved can capacity.

Still a further aspect of the invention is the provision of a can vending machine which allows for ease of loading of cans therein, greatly reducing the risk of misloading, simplifying the loading procedure, and lending itself to capabilities of cartridge loading.

The foregoing and other aspects of the invention which will become apparent as the detailed description proceeds are achieved by a can vending machine, comprising: first and second spaced apart vertical side member; a first set of shelves extending inwardly from said first side member; a second set of shelves extending inward from said second side member, said first and second sets of shelves being alternatingly interleaved and defining a serpentine passage having first and second ends; and dispensing means communicating with said serpentine passage at said second end for dispensing cans from said passage.

Other aspects of the invention are attained by a can vending machine, comprising: first and second serpentine passages, each having a first end for receiving cans therein, and a second end for dispensing cans therefrom; and dispensing means interposed between said second ends for selectively dispensing cans from said serpentine passages.

DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
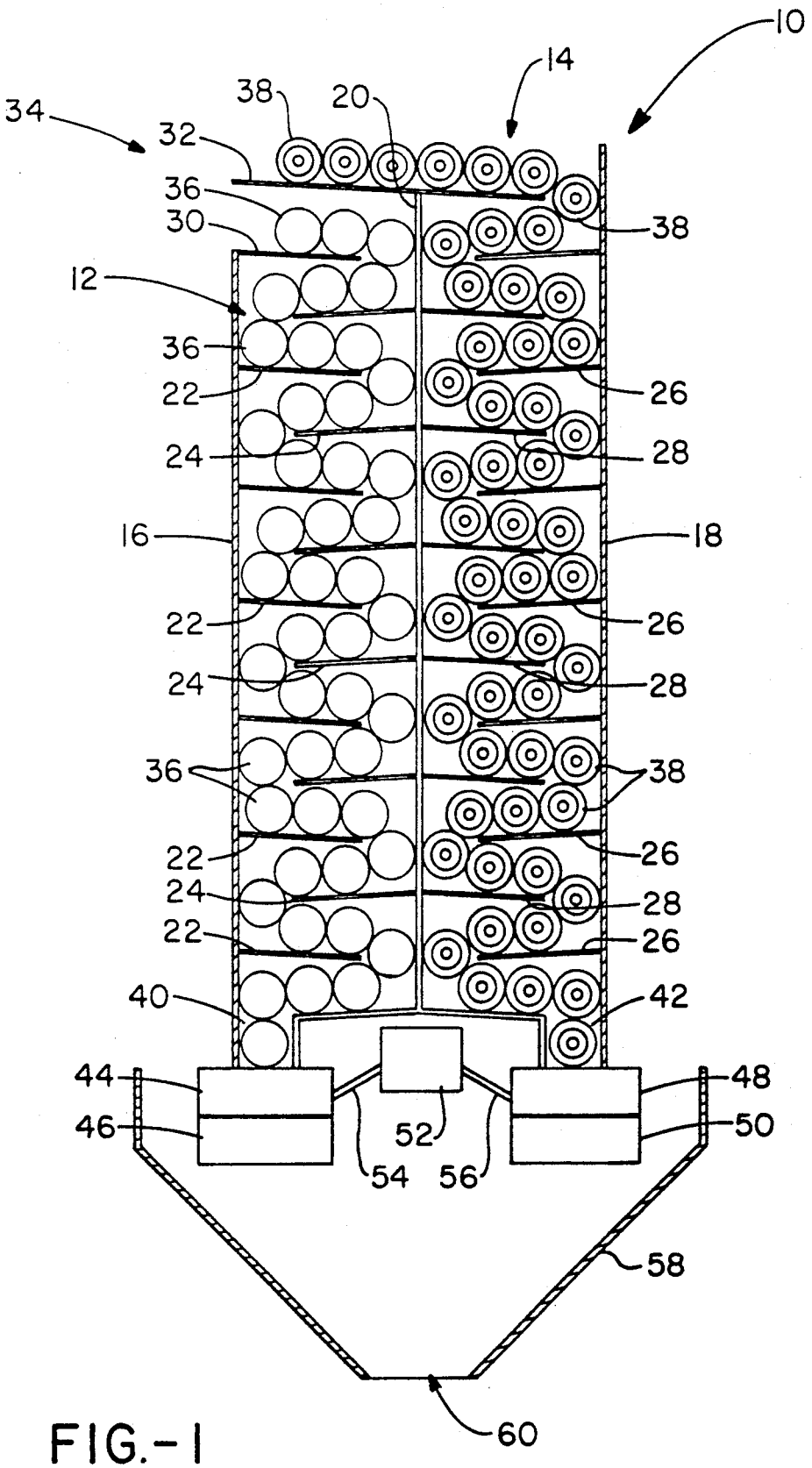
FIG. 1 is a cross sectional view of the can vending machine made according to the invention.

Referring now to the drawing and more particularly FIG. 1, it can be seen that a can vending machine according to the invention is designated generally by the numeral 10. As shown, the machine 10 consists of a first storage area 12 and a second storage area 14, the same being defined by respective side walls 16, 18 with a middle partition 20 interposed therebetween. The side walls 16, 18 and middle partition 20 are preferably vertical and parallel, it being understood that the specific nature and configuration of the storage areas 12, 14 is of general interest to the invention, but may vary as will be perceived by those skilled in the art.

Extending outwardly from the storage area 12 from the side walls 16 are a plurality of shelves 22. In similar fashion, shelves 24 extend inwardly of the storage area 12 from the middle partition 20. Similar shelves 26, 28 extend inwardly of the storage area 14 from the respective side wall 18 and middle partition 20. The shelves 22–28 preferably angle downwardly from their point of interconnection with the appropriate vertical support surface. In a preferred embodiment, each of the shelves 22, 28 angles downwardly at an angle of 2°–5° and, most preferably, at an angle of around 3°. An input or feed plate 30 extends inwardly and declines from the side wall 16 to feed into the storage area 12. In similar manner, an input or feed plate 32 is connected to the middle partition 20 and is angled downwardly as shown to feed into the storage area 14. The input or feed plates 30, 32 terminate in juxtaposition to each other at an opening or access area 34 into which cans can be fed. It will be appreciated by those skilled in the art that service personnel can readily load the storage areas 12, 14 by accessing the area 34 and placing cans upon the respective declined input plates 30, 32. Since the shelves 22–28 extend from their respective vertical support surfaces, and terminate well short of the opposite vertical surface, it will be seen that a serpentine passage is provided within the storage area 12 by shelves 22, 24. In similar fashion, a serpentine passage is provided within the storage area 14 by the alternately interleaved shelves 26, 28.

To load the can vending machine 10, access is simply made at the area 34 and cans 36 are placed upon the feed plate 30. The cans roll downwardly along the plate 30 and are deflected by the middle partition 20 onto the top shelf 24. The downwardly angled nature of the shelf 24 urges the cans 36 therealong until they drop downwardly onto the shelf 22 and so on until the entire storage area 12 is filled. In similar manner, cans 38 are placed upon the input or feed plate 32 and passed downwardly along the declined shelves 26, 28 until the storage area 14 is filled.

At the bottom of the storage area 12, an outlet chute 40 is provided and, in similar fashion, an outlet chute 42 is provided at the bottom of the storage area 14. A rotatable disc or plate 44 is positioned beneath the outlet chute 40, and is maintained in juxtaposition to a stationary disc or plate 46. In similar fashion, a rotatable disc or plate 48 is positioned in communication with the outlet chute 42 and in juxtaposition to a stationary disc or plate 50. An appropriate actuator 52 interconnects through a linkage 54 to the rotatable disc 44, and through a linkage 56 to the rotatable disc 48. When the actuator 52 is actuated as discussed below, a can is dispensed from a selected one of the outlet chutes 40, 42 and passed to the dispensing chute 58 where it is directed to an opening 60 for access by the user of the vending machine 10.

Figure 2:
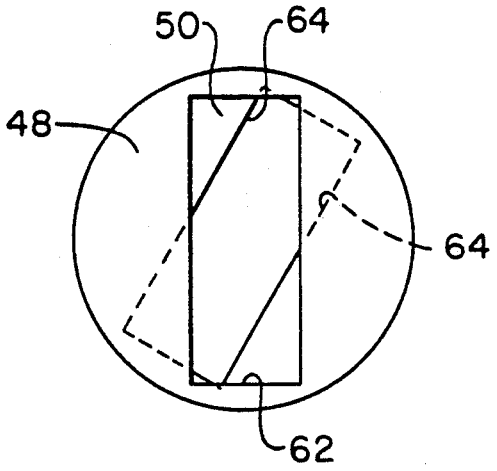
FIG. 2 is a top plan view of the rotating and dispensing plate mechanism of the invention, showing the can passages therethrough.

It will be appreciated that the plates or discs 44, 46 are respectively substantially identical to the plates or discs 48, 50. To appreciate an understanding of the dispensing mechanism of the invention, reference should be had to FIG. 2 wherein a top plan view of the dispensing discs 48, 50 are shown. As illustrated, the discs 48, 50 are coaxial, with the disc 48 being rotatable and the disc 50 being stationary. Passing through the disc 48 is an opening 62 which is substantially equal to, but slightly greater, the size of a can 38 to be dispensed therethrough. In like manner, an opening 64 is provided in the stationary bottom plate 50. The plates 48, 50 are oriented so that the openings 62, 64 may be brought into registration or alignment with each other when the disc 48 is rotated clockwise through an arc of 20°–50°, and preferably on the order of 30°. In the normal nondispensing position, as shown in FIG. 2, the two openings 62, 64 are thus misaligned by about 30°.

It will be appreciated that the disc 48 has a thickness substantially equal to, but slightly greater than, the diameter of each of the cans 38. Accordingly, a can is received within the opening 62 of the plate 48 and is supported by the plate 50. When the actuator 52 is actuated, the disc 48 is caused to rotate clockwise until the openings 62, 64 are in alignment with each other, at which time the can 38 received within the opening 62 passes through the opening 64 and into the chute 58. In an alternative embodiment of the invention, the disc 48 may have a thickness of less than half the diameter of the cans 38 such that the depth of the opening 62 is sufficient to receive a can 38 and rotate the same into alignment with the opening 64. Such an embodiment requires an opening or relief in the side wall of the chute 42 to allow the rotation of the can 38. With this embodiment the size of the plate or disc 48 is greatly reduced. In either embodiment, the plate or disc 50 can be very thin, such as the side walls 16, 18.

Those skilled in the art will appreciate that the actuator 52 can comprise a motor connected by the appropriate linkages 54, 56 and adapted to rotate selected ones of the discs 44, 48 through the required 30° arc. At the end of the dispensing cycle, the discs are returned to their normal state as shown in FIG. 2. At such time, a subsequent can passes into the opening 62 of the disc 48 or, a similar opening in the disc 44. The controlled rotation of the discs may be achieved by the inclusion of a clutch, the implementation of a stepping motor, or by means of mechanical stops.

It will further be appreciated that the actuator 52 could comprise a solenoid connected by appropriate linkages 54, 56 to the rotatable discs 44, 48. Actuation of the solenoid would, in conjunction with the associated linkage 54, 56, cause the associated discs 44, 48 to rotate through the requisite 30° arc. When the solenoid is deactuated, the rotatable disc is caused to return to its normal position.

Figure 3:
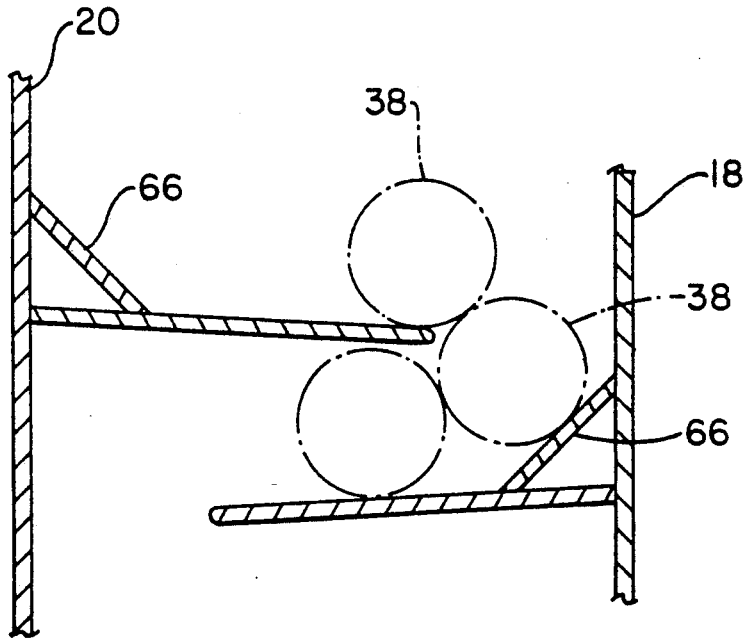
FIG. 3 is a partial sectional view of a serpentine passage of the invention showing the utilization of corner deflector pieces within the passage.

With reference now to FIG. 3, it can be seen that the invention further contemplates the implementation of deflection plates 66 bridging the points of interconnection of the sidewall 18 and angled shelf 26, as well as the middle partition 20 and angled shelf 28. The deflection plates 66 serve to deflect the cans passing along the serpentine passageways in the appropriate direction when they are dropped from the shelf immediately above. As shown in FIG. 3, a can passing from the shelf 28 to the right would be deflected by the plate 66 onto the shelf 26, and so forth.

It should be readily appreciated by those skilled in the art that the shelves 22, 28 serve to support the weight of the cans 36, 38 such that the motors or solenoids employed for actuating the various dispensing mechanisms can have minimum torque characteristics. Only the vertical weight of a can or two is actually imposed upon the actuator 52. It will further be seen that a single actuator can serve multiple stacks or columns of cans and the size of the motors or solenoids can be standardized throughout the entire dispensing system. Additionally all of the cans to the stacks are loaded at the same point, and the cans pass automatically down the associated serpentine passages to fill the appropriate storage area 12, 14. Access to the vending machine 10 at a single point is all that is required by the service personnel.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A can vending machine, comprising:

first and second spaced apart vertical side members;

a first set of shelves extending from said first side member toward said second side member;

a second set of shelves extending from said second side member toward said first side member, said first and second sets of shelves being angled downwardly in extension from said respective side members and alternatingly interleaved and defining a serpentine passage having first and second ends; and dispensing means communicating with said serpentine passage at said second end for dispensing cans from said passage, said dispensing means comprising a rotatable plate and a stationary plate, said plates having complimentary openings passing therethrough, said openings accommodating passage of said cans, said rotatable plate having a normal position in which said openings of said plates are misaligned by 20°-50°, such that a can received in said opening of said rotatable plate rests upon said stationary plate.

2. The can vending machine according to claim 1, wherein said shelves extend from respective ones of said side members.

3. The can vending machine according to claim 1, wherein said shelves angle downwardly at an angle of 3°-5°.

4. The can vending machine according to claim 1, wherein deflection plates interconnect said shelves and respective side members.

5. The can vending machine according to claim 1 wherein said rotatable plate is interposed between said stationary plates and said second end of said serpentine passage.

6. The can vending machine according to claim 1, wherein said dispensing means further comprise a motor interconnected with said rotatable plate.

7. The can vending machine according to claim 1, wherein said dispensing means further comprises a solenoid interconnected with said rotatable plate.

8. The can vending machine according to claim 1, wherein said serpentine passage receives cans at said second end thereof.

9. A can vending machine, comprising:

first and second vertically extending serpentine passages, each having a first end for receiving cans therein, and a second end for dispensing cans therefrom; and dispensing means interposed between said second ends for selectively dispensing cans from said serpentine passages, said dispensing means comprising a pair of plates communicating with each of said passages, each of said pairs of plates comprising a first stationary plate and a second rotatable plate, said first and second plates having openings therethrough for receiving and passing cans, said openings of said plates being selectively aligned and misaligned with each other, and a single motor interconnected with said rotatable plates of each of said pairs of plates.

10. The can vending machine according to claim 9, wherein said serpentine passages each have an outer wall and share a common middle partition.

11. The can vending machine according to claim 10, wherein said first serpentine passage is defined by interleaved shelves extending alternately from one of said outer walls and said middle partition, and said second serpentine passage is defined by interleaved shelves extending alternately from the other of said outer walls and said middle partition.

12. The can vending machine according to claim 11, wherein said first ends of said passages are in juxtaposition to each other.

13. The can vending machine according to claim 9, wherein said dispensing means comprises a solenoid interconnected with said rotatable plate of each of said pairs of plates.

* * * * *